US005657945A

United States Patent [19]

Bryant

[11] Patent Number: 5,657,945

[45] Date of Patent: Aug. 19, 1997

[54] POWERIZED UNROLLER

[75] Inventor: Tim L. Bryant, Campbellsville, Ky.

[73] Assignee: Union Underwear Company, Inc., Bowling Green, Ky.

[21] Appl. No.: 596,509

[22] Filed: Feb. 5, 1996

[51] Int. Cl.[6] ..... B65H 16/08; B65H 16/10

[52] U.S. Cl. ..... 242/563; 242/564.4; 242/564.5; 242/595.1

[58] Field of Search ..... 242/563, 564.4, 242/564.5, 595.1

[56] References Cited

U.S. PATENT DOCUMENTS

| | | | |
|---|---|---|---|
| 2,220,230 | 4/1940 | Gilbert . | |
| 2,746,511 | 5/1956 | Branthoover | 242/564.5 |
| 2,757,880 | 8/1956 | De La Motte | 242/564.5 |
| 3,334,838 | 8/1967 | Kopp | 242/564.5 |
| 3,861,610 | 1/1975 | Landis et al. | 242/564.4 |
| 4,096,907 | 6/1978 | Krall et al. | 226/186 |
| 4,738,407 | 4/1988 | Arrant | 242/564.5 |
| 5,195,690 | 3/1993 | Cross . | |
| 5,211,036 | 5/1993 | Engelfried . | |
| 5,472,153 | 12/1995 | Crowley et al. | 242/564.5 |

FOREIGN PATENT DOCUMENTS

| | | | |
|---|---|---|---|
| 62-185661 | 8/1987 | Japan | 242/564.5 |

*Primary Examiner*—John M. Jillions

*Attorney, Agent, or Firm*—Middleton & Reutlinger; John F. Salazar

[57] ABSTRACT

A powerized apparatus utilized in handling and unrolling large rolls of fabric, on the order of 600 pounds has pneumatically controlled air cylinders to raise and lower a loading door for proper loading of large fabric rolls. Dual air actuators are connected to two pinch rollers to pull fabric up and away from the large fabric roll. Within the containment bin are a plurality of rollers which allow the large fabric roll to spin within the containment bin, two of said rollers powerized to turn the fabric roll. When activated, the apparatus not only rotates the large fabric roll but also pulls the material through the pinch rollers at a high rate of speed, up to about 310 yards/minute. The containment bin also has an adapting unit for placement of smaller 50 pound fabric rolls within the containment bin.

24 Claims, 8 Drawing Sheets

POWERIZED UNROLLER

BACKGROUND OF THE INVENTION

1. Field of the Invention

The present invention relates to fabric handling machinery and particularly to machinery which unrolls large rolls of fabric at a high rate of speed.

2. Discussion of the Prior Art

When manufacturing fabric, typically a circular needle cylinder is utilized to create a roll of tubular fabric which is collected around a central spindle. The tubular fabric roll created typically has been on the order of about 50 pounds of material. The light weight of these relatively small tubular fabric rolls has not created handling problems when further processing of the fabric rolls is required. However, new circular knitting machinery can now create tubular fabric rolls which are much larger than the previously small 50 pound rolls. These new machines can create tubular fabric rolls that can weigh as much as 600 to 800 pounds. Handling of these larger rolls of fabric becomes a much more difficult task. Specifically, the rolls, after knitting, must be unraveled as the tubular fabric is fed into the next processing step, generally bleaching and dyeing.

Machines which are currently used for unrolling the smaller 50 pound rolls of fabric are comprised of a simple cradle having free spinning rollers contained therein for easy rotation of a small fabric roll placed within said cradle. This method of unrolling material into the bleach and dye process is not appropriate for larger rolls, nor will it allow the fabric to be spun off of the storage roll at a high rate of speed required in order to reduce the processing time of the material.

SUMMARY OF THE INVENTION

It is therefore an object of the present invention to handle and unroll large rolls of tubular fabric at a high rate of speed. It is a further object of the present invention to safely handle large rolls of tubular fabric and provide an adequate power source for the large roll to be unraveled in a controlled operation. It is an even further object of the present invention to provide a powerized unroller for large rolls of tubular fabric which retains the large roll in a containment bin and not only turns the roll of fabric itself but also pulls the unraveled fabric from the roll. Also, it is an object of the present invention to adapt the unroller to both large and small rolls of fabric.

With these objectives in mind, the present invention is for an apparatus for receiving an oversized tubular fabric roll in a containment bin and unraveling said fabric roll at a high rate of speed. The high speed unraveling apparatus provides a containment bin for receiving a large roll of fabric, said containment bin having a plurality of support rollers which rests directly against the roll placed therein. The lower two rollers within the containment bin are rotated by an independent drive which in turn spins the roll of material resting thereon. The fabric is also fed through a first and a second pinch roller which receives the unwound fabric therebetween. The pinch rollers, which are also driven by a separate drive source, are pneumatically compressed against the fabric which is fed therebetween. The material is then drawn from the roll at a high rate of speed and fed to the next processing step, typically the bleaching and dyeing.

More particularly, the present invention comprises a powerized unroller for unrolling fabric rolls, comprising: a containment bin having a plurality of support rollers and at least one drive roller located therein; a loading door providing access to said containment bin; a first and second side support member extending upwardly from said containment bin; a first and second pinch roller extending between said first and said second side support member and in parallel relation with each other; at least one proximity sensor for detecting the presence of fabric unrolling from said powerized unroller; means to rotate said first pinch roller; and, means to rotate said at least one drive roller.

Other advantages of this invention will appear to those skilled in the art upon reading the following description and appended claims.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
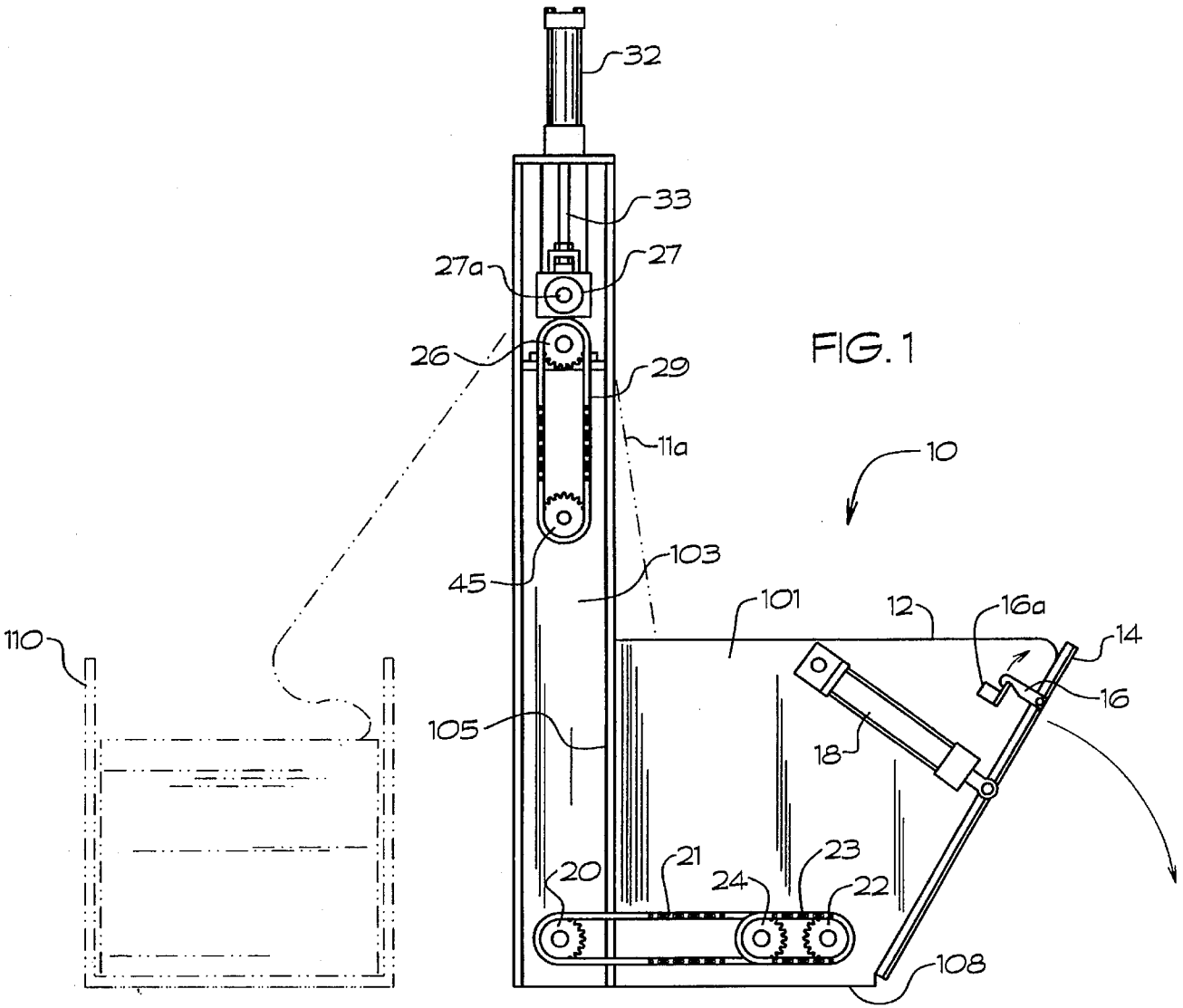
FIG. 1 is a side view of the power unroller of one preferred embodiment of the present invention.

Reference is now made to FIG. 1 wherein a powerized unroller 10 of the present invention is shown. Power unroller 10 is comprised of loading door 14 which provides access to fabric roll containment bin 12 and allows large rolls of fabric 11 to be properly loaded within said containment bin 12. Containment bin 12 is formed by loading door 14, two side walls, only side wall 101 being shown, rear wall 105 and base 108.

Figure 2:
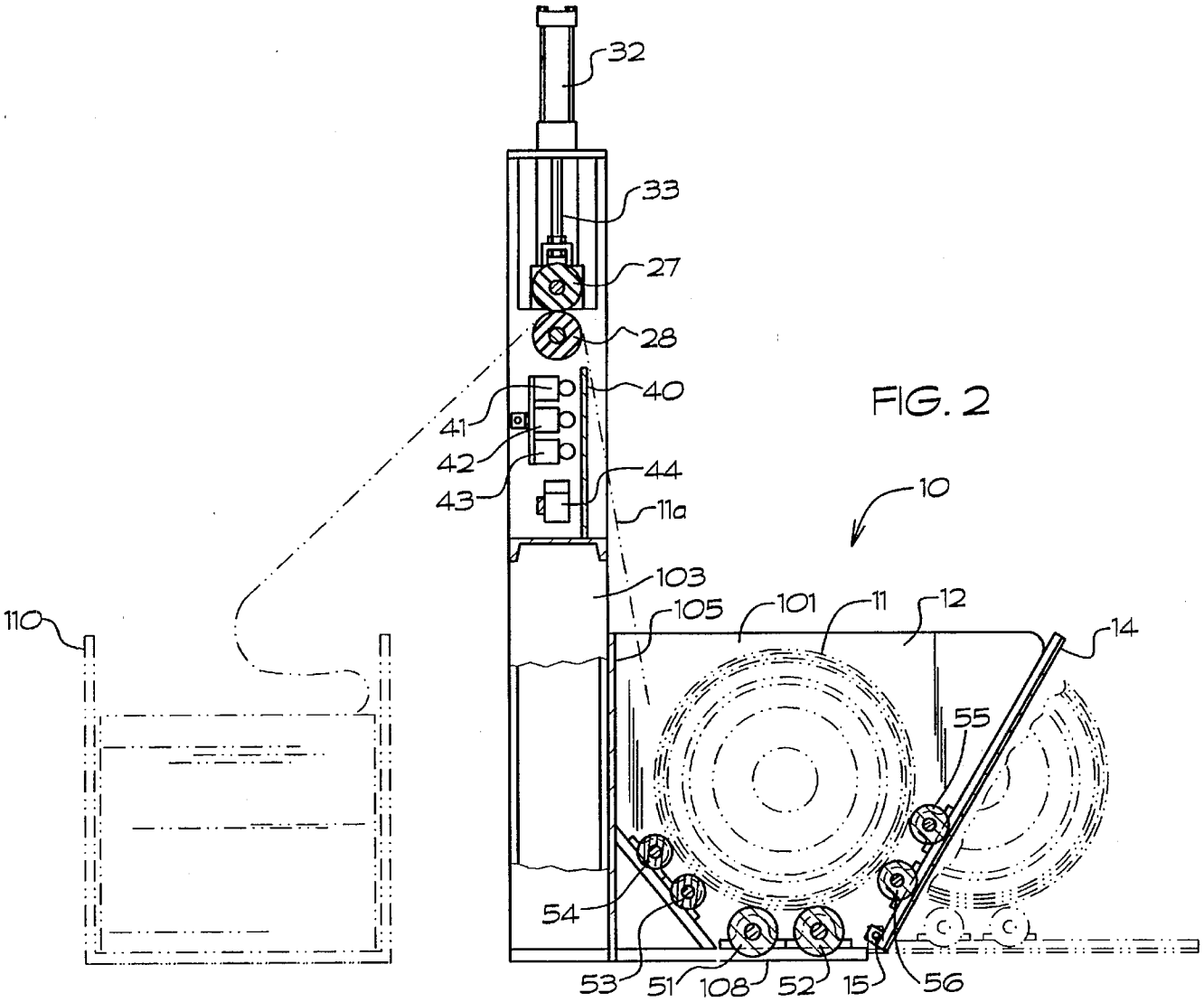
FIG. 2 is a side view of the power unroller of FIG. 1 with the drive rollers and pinch rollers exposed.

As shown in FIG. 2, inside containment bin 12 is placed a large roll of tubular or other fabric 11. Within containment bin 12 is provided support rollers 51, 52, 53, 54, 55 and 56 upon which large fabric roll 11 rests. These support rollers allow fabric roll 11 to freely spin within containment bin 12 and also rotate fabric roll 11 when unroller apparatus 10 is activated. Each support roller is preferably made of stainless steel and has large size bearings at each end to support the high weights associated with fabric rolls 11. Lower drive rollers 51 and 52 are somewhat larger in diameter than support rollers 53, 54, 55 and 56. Rollers 51 and 52 are generally about 5 inches in diameter while support rollers 53, 54, 55 and 56 are only about 3 inches in diameter. Drive rollers 51 and 52 are rotated by sprocket assembly 22 and 24 shown in FIG. 1 which allows a single drive source or motor 19 to turn fabric roll 11 located in containment bin 12. Drive rollers 51 and 52 rotate to turn the large roll of fabric located within containment bin 12. Smaller support rollers 53, 54, 55 and 56 are free spinning and keep roll 11 spinning easily within bin 12 while powerized drive rollers 51 and 52 are rotated. Fabric roll 11 is supported entirely by the plurality of rollers within the containment bin 12 and turns freely thereon.

As best shown in FIG. 2, when unrolling, fabric stream 11*a*unwinds from the roll 11, enters through pinch rollers 27 and 28 and is spun into storage bin 110. Drive rollers 51 and 52 located within containment bin 12 are powered to turn fabric roll 11 while pinch roller 28 is also powered to pull fabric through dual pinch rollers 27 and 28 and thereby unroll fabric roll 11 at a high rate of speed for entry into the bleach and dye facility.

Figure 3:
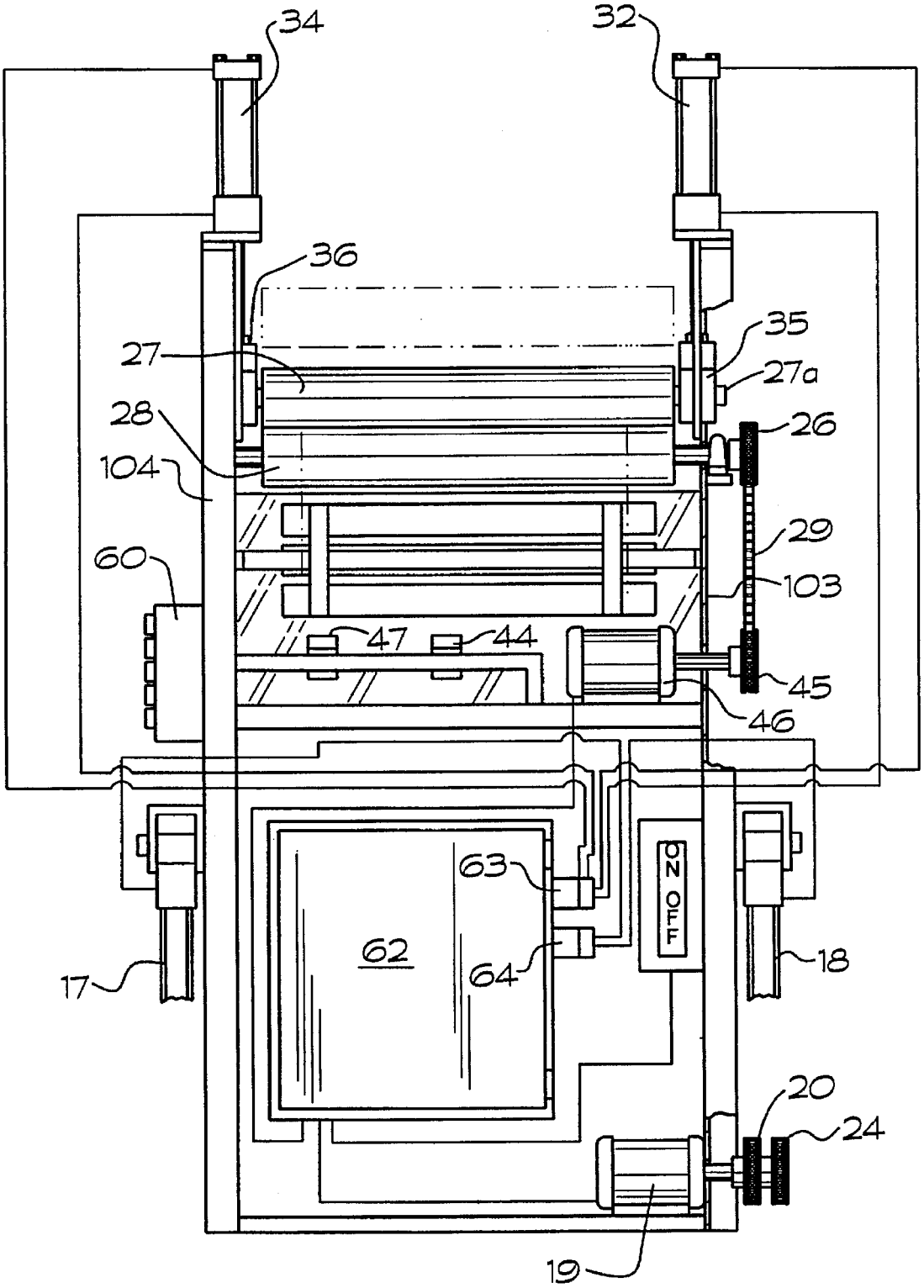
FIG. 3 is a rear view of the power unroller of FIG. 1.
Figure 5:
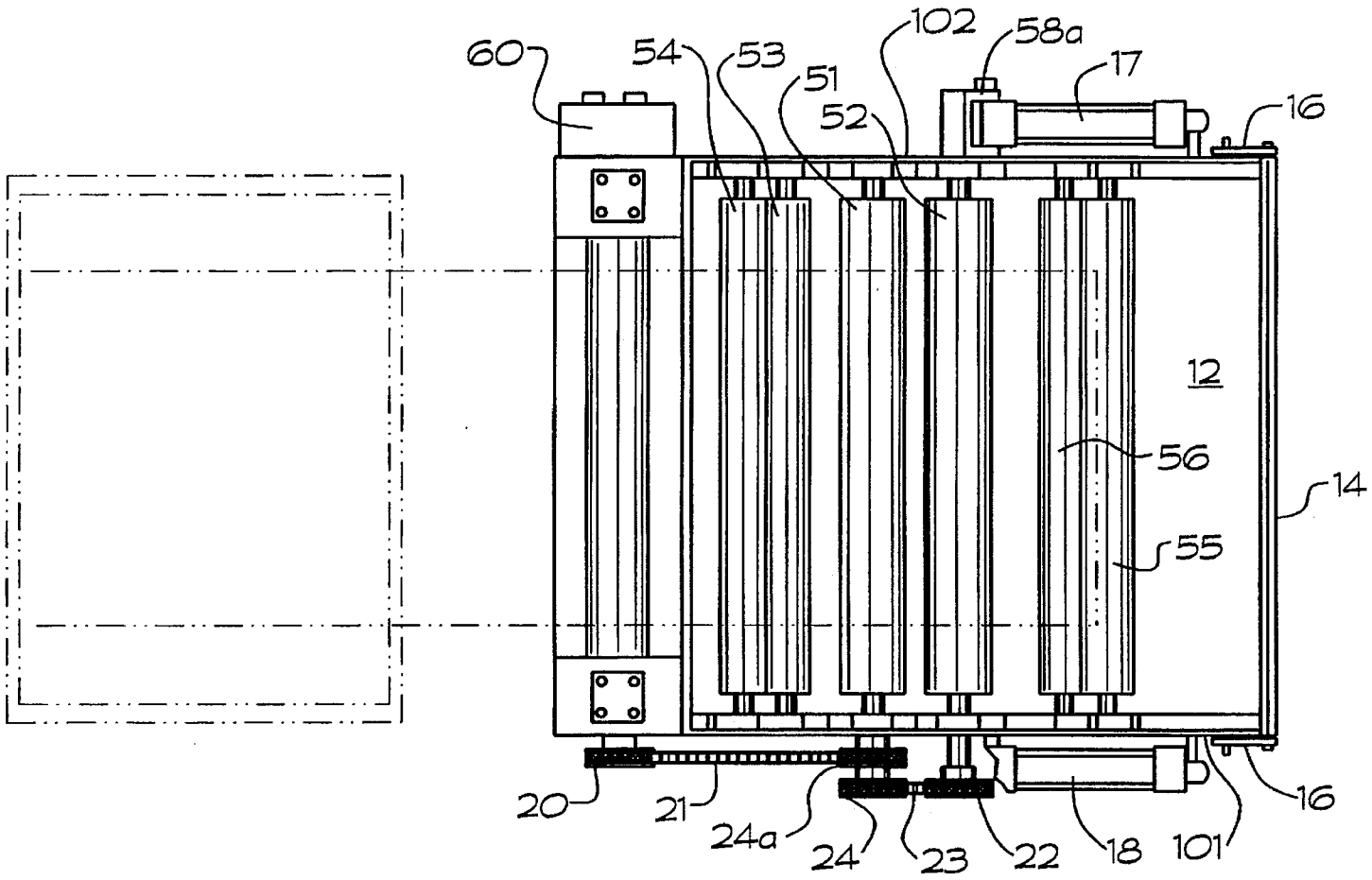
FIG. 5 is a top view of the power unroller of FIG. 1 showing the interior of the containment bin.

Containment bin loading door 14 hinges about connecting hinge 15 and has free spin support rollers 55 and 56 attached thereto. Loading door 14 is operable in response to air cylinder 17 and 18 which are positioned on opposite sides of bin 12, as shown in FIG. 3 and FIG. 5. The air cylinders 17 and 18 are pneumatically controlled by compressed air. Each air cylinder is rated at a lifting capacity of about 300 pounds bringing the total lifting capacity of loading door 14 to about 600 pounds. Loading door 14 is secured in the closed position by the co-operating relation of spring loaded J-hook 16 and latch clips 16*a* which are located on both outer walls 101 and 102 of containment bin 12.

Drive rollers 51 and 52 located within containment bin 12 are rotated by sprockets 22 and 23 which in turn are driven by drive sprocket 20. Drive sprocket 20, which is exemplified as being 5.5 inches in diameter is turned by the drive shaft of motor 19 which is a standard 2 HP motor. Chain 21 is provided to in turn rotate interior sprocket 24*a* and outer sprocket 24 attached to the center shaft of drive roller 51. Mid-outer sprocket 24 in turn drives sprocket 22 via chain 23, sprocket 22 being attached to the center shaft of drive roller 52. Motor 19 provides enough power to smoothly turn a large capacity fabric roll 11 which may weigh up to 600 pounds. The drive rollers cause the roll of fabric 11 to spin at an unravelling speed of up to about 310 Yards per Minute.

In FIG. 5, the internals of containment bin 12 are shown. Support rollers 51, 52, 53, 54, 55 and 56 are shown as well as loading door 14 and spring loaded latch 16. Sprocket 20 is shown in driving relation with drive motor 19. Drive roller 51 is attached to drive sprocket 24 and 24*a*, sprocket 24 turning adjacent drive roller 52. Chains 21 and 23 connect each of the drive sprockets together so the drive rollers 51 and 52 cooperatively drive chains 21 and 23. Both air cylinders 17 and 18 are also shown which raise and lower loading door 14 with a combined lifting capacity of about 600 pounds.

Figure 4:
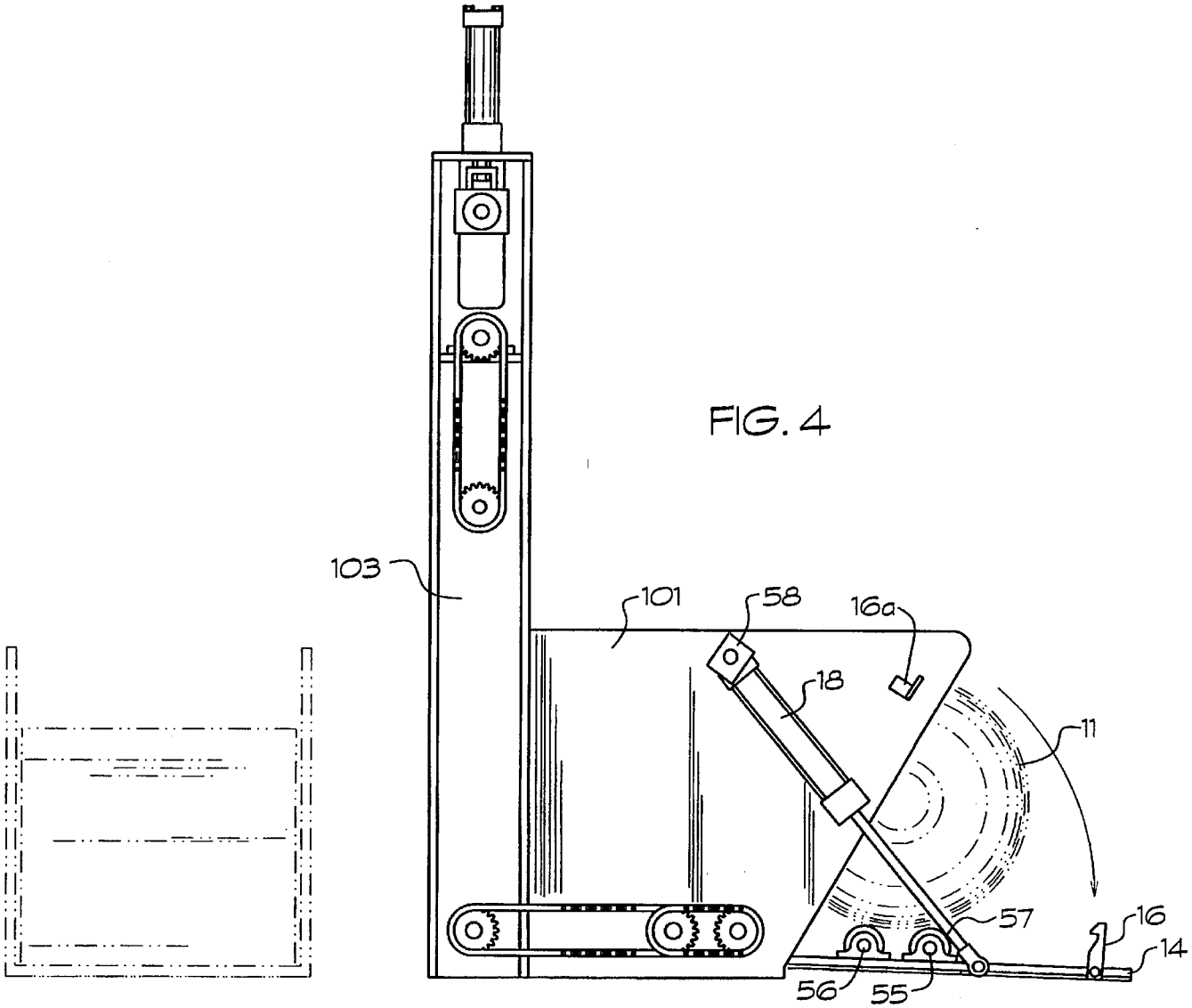
FIG. 4 is a side view of the power unroller of FIG. 1 showing the containment bin door open.

As shown in FIG. 4, loading door 14 is fully opened after air cylinders 17 and 18 have been pneumatically activated and air cylinder piston 57 fully extended outside of air cylinder 18. In order to properly load fabric roll 11 into containment bin 12, loading door 14 is opened and fabric roll 11 is placed upon support rollers 55 and 56. Air cylinders 17 and 18 pivot about connecting points 58 and 58*a* located on side walls 101 and 102 so that, as door 14 is lowered, alignment of air cylinders 17 and 18 and air cylinder piston 57 may adjust accordingly, as shown in FIG. 4. Connecting mounting brackets 58 and 58*a* swivel on side walls 101 and 102 so that air cylinders 17 and 18 may rotate about the brackets 58 and 58*a*. Thus, air cylinders 17 and 18 must therefore have the ability to rotate about connecting points 58 and 58*a* to allow for such slight change in angle. The air cylinders have mounts which accept a fixed pin which are in turn fixed to side wall brackets. Air cylinder piston 57 fully extends in order to place door 14 in horizontal alignment. A fabric roll 11 may be placed atop door 14 on support rollers 55 and 56 and air cylinders 17 and 18 activated to raise door 14 thereby causing roll 11 to fully enter into containment bin 12. Air cylinder piston 57 retracts into the air cylinder thereby closing the door and placing the roll 11 into the containment bin 12.

As shown in FIG. 1 and 3, vertical side support members 103 and 104 form an area between which fabric stream 11*a* passes through. Pinch rollers 27 and 28 are shown as being approximately 5 inches in diameter and 40 inches long and are generally made of stainless steel. The surface of each of the pinch rollers are such that one roller is smooth stainless steel and the other roller is coated with a rubberized material. Fabric stream 11*a* travels between side support members 103 and 104, between compression pinch rollers 27 and 28 and into a storage bin 110. The center shaft 27*a* of pinch roller 27 is connected to air actuators 32 and 34 via piston cylinder 33, as shown in FIG. 1. Pinch roller 27 has at each distal end bearing and slide blocks 35 and 36 which move vertically within channels formed in side support members 103 and 104. Air actuators 32 and 34 have, for example, a poundage rating of around 100 pounds and are readily commercially available. Air actuators 32 and 34 compress pinch roller 27 against roller 28 so that fabric stream 11*a* is securely held therebetween. Air actuators 32 and 34 reciprocally actuate pinch roller 27 so roller 27 may raise and lower as powerized unroller 10 is activated. Pinch roller 28 is connected at one end to sprocket 26 which is driven by belt or chain 29 attached to drive sprocket 45. Motor 46 has a drive shaft attached to sprocket 45 which causes pinch roller 28 to rotate at about, for example, 310 Yards per Minute. Upper pinch rollers 27 and 28 spin at a slightly higher rate of speed than lower drive rollers 51 and 52 because the fabric stream must have the proper amount of tension or backlashing of the fabric will occur. Drive sprocket 26 is larger in diameter than lower drive sprocket 20 in order to keep fabric stream 11*a* correctly aligned between pinch rollers 27 and 28.

During normal operation, air actuators 32 and 34 keep roller 27 retracted providing an opening between rollers 27 and 28. Upon activation of machine 10 when fabric is located between pinch rollers 27 and 28 and a fabric roll 11 is placed within containment bin 12, actuators 32 and 34 are pneumatically activated causing roller 27 to lower and come into contact with roller 28 thereby compressing fabric stream 11*a* therebetween. When actual unrolling of material fabric roll 11 is occurring, motor 46 causes roller 28 to rotate. Material 11 is then not only unrolled from the fabric roll within containment bin 12 but is also pulled through pinch roller 27 and 28 so that high speed unrolling of the material occurs at about 310 yards/minute.

As shown in FIG. 3, located between side support members 103 and 104 are proximity sensors 44 and 47 used to determine if fabric is located within 15 inches in front of either detector 44 and 47 thereby allowing the machine 10 to run full speed. Proximity sensors or motion detectors 44 and 47 are of the type such as MPD4 Light Diffuser Sensor manufactured by Microswitch Inc. and sense the presence of a fabric stream 11*a* being pulled in front of the sensors and through pinch rollers 27 and 28 and enables the continued rotation of motors 19 and 46. When proximity sensors 44 and 47 do not detect the presence of fabric stream 11*a*, motors 19 and 46 are shut down and air actuators 32 and 34 activated in order to separate pinch rollers 27 and 28. This automates the unrolling process so the machine 10 may automatically unroll large fabric rolls and shut itself down when completed.

Shown in FIG. 2, lights 41, 42 and 43 are provided in order to give the operator ample light source to inspect material stream 11*a* passing through pinch rollers 27 and 28. Upon activation of lights 41, 42 and 43, the apparatus 10 enters inspection mode slowing the speed of fabric stream down from 310yards per minute to only 50 yards per minute. Lights 41, 42 and 43 are thus actuated with motors 19 and 46 to work in combination to provide a means for the operator to inspect the fabric stream 11*a* while apparatus 10 is unrolling fabric roll 11 at a slower rate of speed.

Located between sensors 44 and 47 and lights 41, 42, 43 and fabric stream 11*a* is plexiglass 40 which prevents dust and other undesirable material from covering the proximity sensors and lights while also protecting the bulbs from other safety hazards.

Referring now to FIG. 3, electrical control box 62 houses the control mechanism for power unrolling machine 10. Air regulators 63 and 64 are provided to control the passage of air to air actuators 32 and 34 and air cylinders 17 and 18. Air regulator 63 controls flow of air to upper air cylinders 32 and 34, independently. Electrical switching (not shown) within switch box 60, are in actuating relation with air cylinders 17, 18 whereby upon activating air cylinders 17 and 18, door 14 is opened or closed. In a door open condition, a large fabric roll 11 may be placed upon door 14. De-energizing the air cylinders 17 and 18 closes door 14 causing roll 11 to enter the containment bin 12 of machine 10. When roll 11 enters bin 12, rollers 27 and 28 are separated in an inactive position allowing the operator to place the loose end of the roll of fabric 11 through pinch rollers 27 and 28. Air actuators 32 and 34 are provided to force roller 27 downward compressing the fabric 11 between rollers 27 and 28. Rollers 51 and 52 are operable in response to motors 19 and 46. Activation of rollers 51 and 52 turns fabric roll 11 and in turn pulls fabric through pinch rollers 27 and 28 causing the high speed unrolling of fabric roll 11 at speeds of about 310yards/min.

Figure 6:
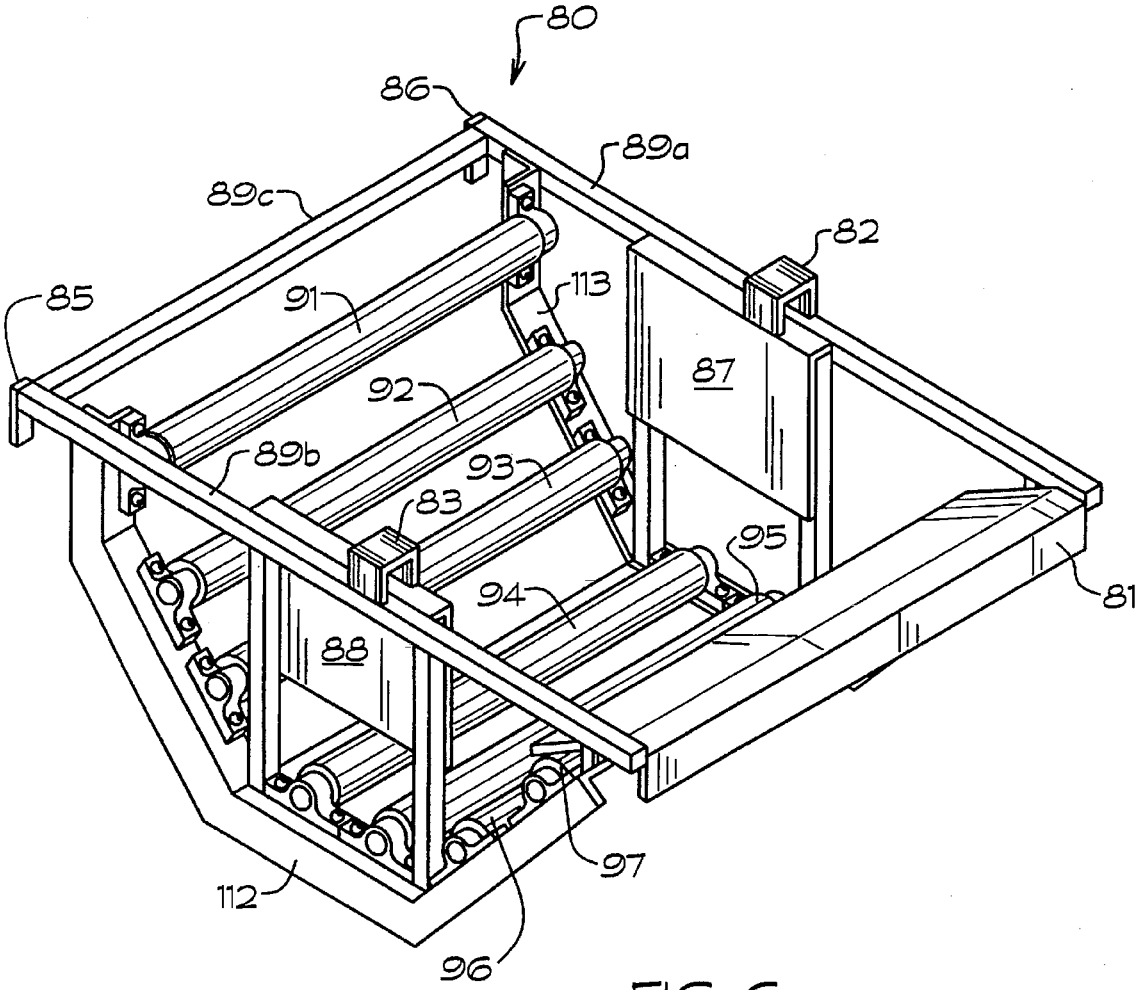
FIG. 6 is a perspective view of an adapting unit which is installed in the containment bin of the power unroller.
Figure 7:
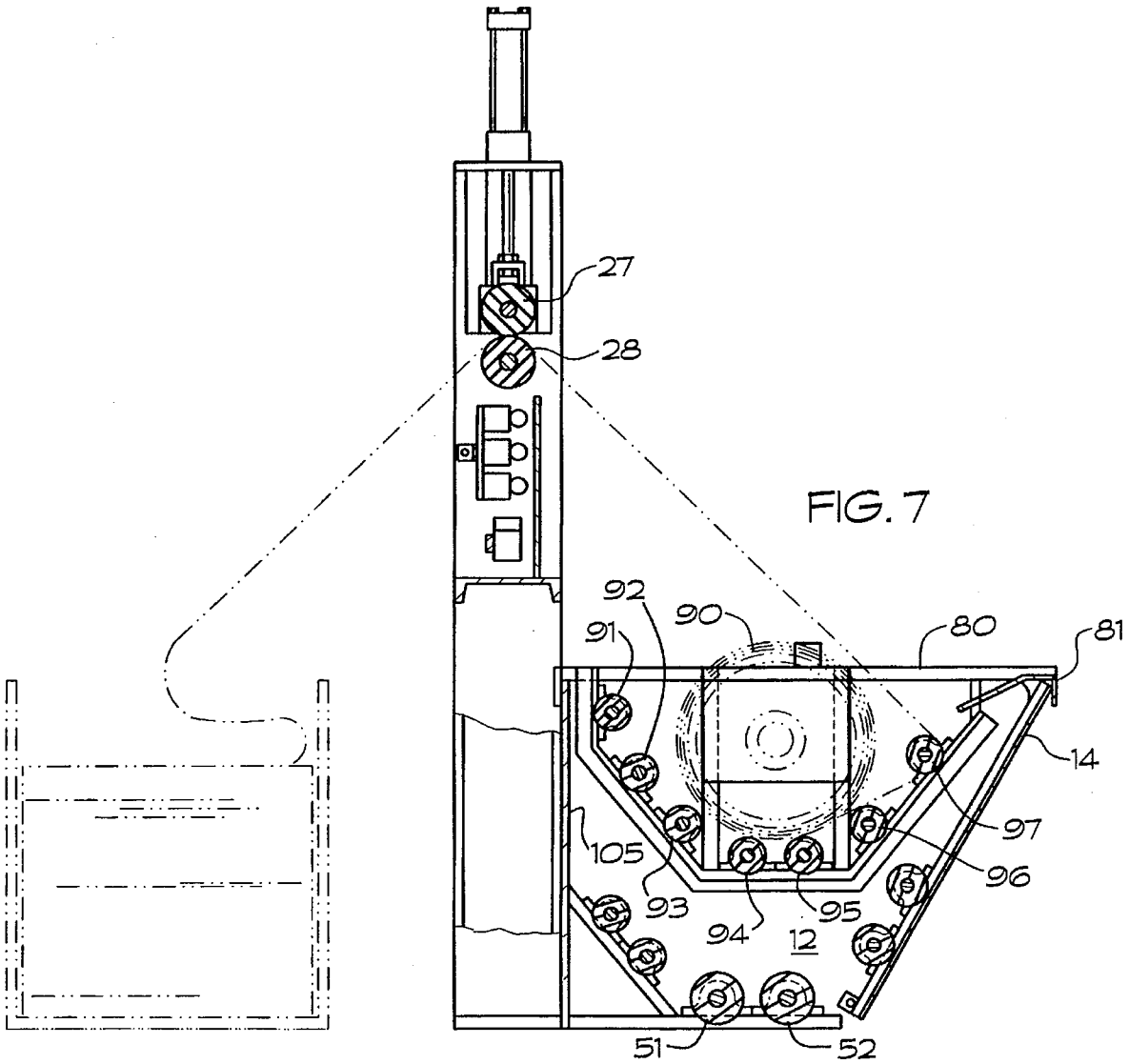
FIG. 7 is a side view of the power unroller of FIG. 1 with the adapting unit installed in the containment bin and exposing support rollers; and, FIG. 8 is top view of the power unroller of FIG. 7 with the adapting unit installed in the containment bin.
Figure 8:
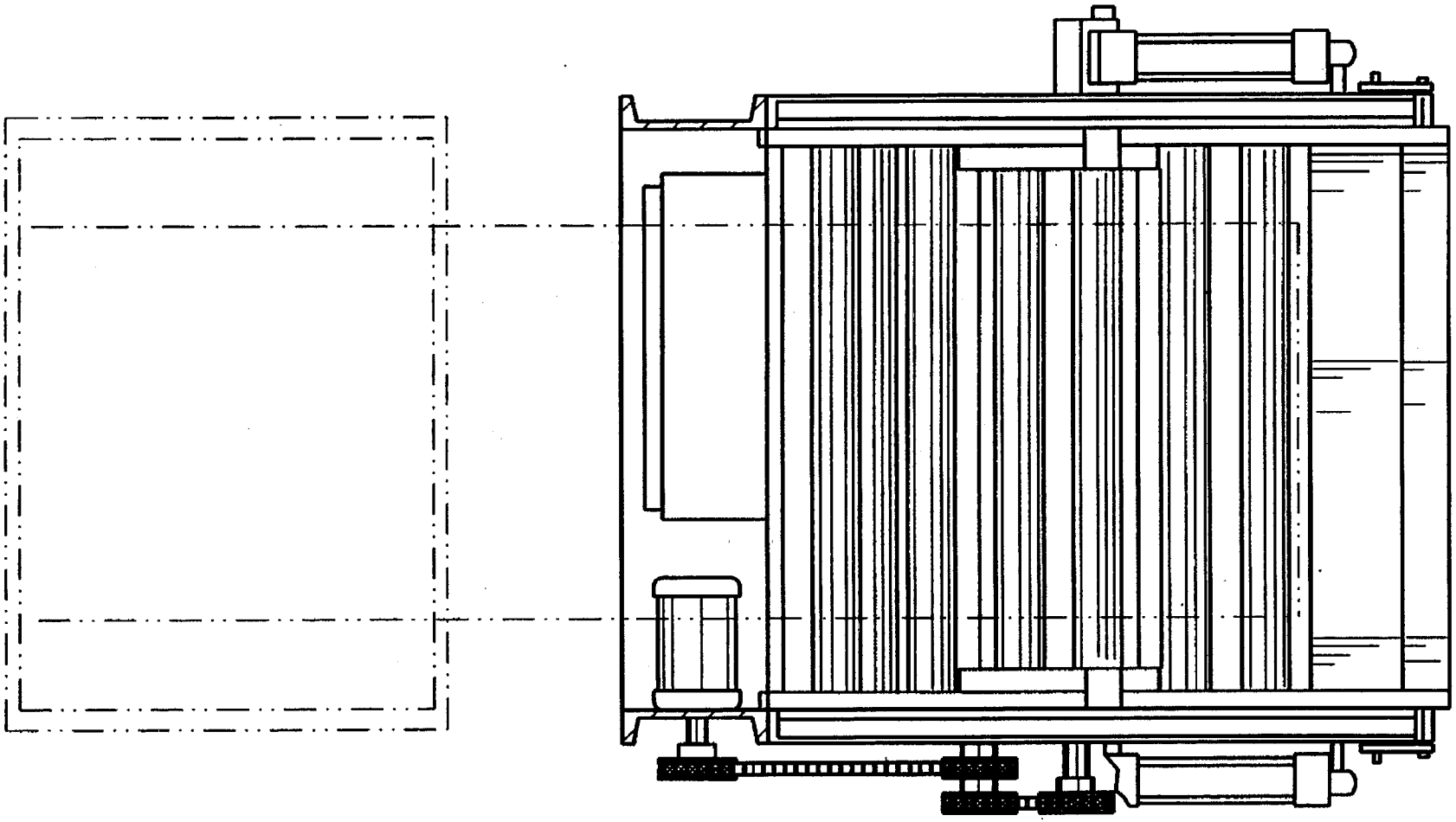

Turning now to FIG. 6, adapting unit 80 is shown which enables power unrolling machine 10 to unravel a smaller fabric roll 90 which is on the order of about 50 pounds. Adapting unit 80 is provided with front lip 81 and rear hooks 85 and 86 so that the unit may be securely placed within containment bin 12 of unroller 10. Front lip 81 is engageable over the top of loading door 14 and rear hooks 85 and 86 overlap the top of containment bin rear wall 105 securely placing adapting unit 80 within bin 12, as shown in FIG. 7. Rectangular eyelet inserts 82 and 83 are provided for aid in removal of the adapting unit 80 from containment bin 12 or for insertion of the unit 80 into bin 12. Eyelets 82 and 83 are formed upon side support runners 89*a* and 89*b* which connects front lip 81 with rear support runner 89*c*. Cradle supports 112 and 113 provide a cavity within which a plurality of free spinning support rollers, 91, 92, 93, 94, 95, 96 and 97 are placed. Extending between cradle supports 112 and 113 are rectangular side walls 87 and 88. Side walls 87 and 88 allow the distal ends of smaller fabric roll 90 (FIG. 7) to rotate about a smooth surface by providing a flat planar surface 88, 87 which abuts directly against the ends of roll 90. Support rollers 91, 92, 93, 94, 95, 96 and 97 are provided to allow fabric roll 90 to spin freely within adapting unit 80.

In operation, fabric of roll 90 is first wrapped around roller 97 then between pinch rollers 27 and 28 so that adequate tension will be kept on the fabric itself while the unrolling occurs. Drive rollers 51 and 52 within containment bin 12 spin freely while adapting unit 80 is in place. Front loading door 14 may not be opened while adapting unit 80 and front lip member 81 are inserted in the containment bin. Unrolling of fabric roll 90 may occur at a high rate of speed, around 310 yds/min.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A powerized unroller for unrolling fabric rolls, comprising:

a containment bin having and a first and second drive roller within said containment bin and in parallel relation with each other, said containment bin having a loading door providing access to said containment bin, and a plurality of free spinning support rollers in parallel relation to said drive rollers and located said loading door;

first and second side support members extending upwardly from said containment bin;

first and second pinch rollers extending transversely between said first and said second side support member, said pinch rollers being in parallel relation;

means to rotate said first pinch roller; and, means to rotate said at least one drive roller.

2. The powerized unroller of claim 1 further comprising at least one proximity sensor for detecting the presence of fabric unrolling from said powerized unroller, said sensor disposed between said bin and said pinch rollers.

3. The powerized unroller of claim 1 further comprising a first and a second air cylinder attached at one end to said containment bin and at the opposite end to said loading door for raising and lowering said loading door.

4. The powerized unroller of claim 1 further comprising a first air actuator attached at an uppermost end of said first side support member and a second air actuator attached at an uppermost end of said second side support member, said first and second air actuator reciprocally connected to said second pinch roller.

5. The powerized unroller of claim 1 wherein said first pinch roller has a rubber material coated thereon.

6. The powerized unroller of claim 1 wherein said drive roller and said pinch rollers are about 5 inches in diameter.

7. The powerized unroller of claim 1 wherein said plurality of support rollers are about 3 inches in diameter.

8. A high speed fabric unrolling apparatus, comprising:

a containment bin for receiving a fabric roll;

a loading door hingedly connected to said containment bin, wherein said loading door has a first and a second free spinning support roller located thereon;

a first and a second drive roller located within said containment bin for rotating said fabric roll;

a first and second side support member extending vertically from said containment bin;

a first and a second pinch roller extending transversely between said first and second side support member; and, a drive motor operably connected to said first pinch roller.

9. The apparatus of claim 8 wherein said containment bin including a first and a second side wall and a rear wall.

10. The apparatus of claim 8 wherein said containment bin further comprises a plurality of free spinning support rollers.

11. The apparatus of claim 8 wherein said loading door has a first and a second air cylinder attached thereto for raising and lowering said door.

12. The apparatus of claim 8 including a first and a second air actuator attached at opposite ends of said second pinch roller.

13. The apparatus of claim 8 further comprising at least one light emitting source and at least one proximity sensor for detecting the presence of fabric loaded in said apparatus.

14. The apparatus of claim 8 wherein said first and second drive roller are operably connected to a drive motor.

15. The apparatus of claim 8 wherein said first pinch roller is coated with a rubber material.

16. The apparatus of claim 8 further comprising means for deactivating said first and said second drive roller and said drive motor when fabric is not detected between said first and second pinch roller.

17. An apparatus for loading and rapid unrolling of a large capacity fabric roll, comprising:

a containment bin having a front loading door, a first and second side wall, a rear wall and a base, said front loading door hingedly connected to said base;

a first and second air cylinder connected to said loading door for raising and lowering said door;

a first and a second drive roller located within said containment bin and supporting said fabric roll;

a first motor drive attached to said containment bin and operably connected to said first and said second drive roller;

a first and a second side support member extending vertically from said containment bin;

a first and a second pinch roller, said pinch rollers connected at one distal end to said first side support member and at the opposite distal end to said second side support member;

a second drive motor operably connected to said first pinch roller; and, means for raising and lowering said second pinch roller.

18. The apparatus of claim 17 wherein said means for raising and lowering said second pinch roller further comprise a first air actuator attached to said first side support member, said first air actuator having a cylinder extending downward through said first side support member and attached to said second pinch roller at a one distal end and a second air actuator attached to said second side support member, said second air actuator having a cylinder extending downward through said second side support member and attached to said second pinch roller at an opposite distal end.

19. The apparatus of claim 18 wherein said one distal end and said opposite distal end of said second pinch roller have a bearing and slide block attached thereon for sliding vertically within said first and said second side support members.

20. The apparatus of claim 17 wherein said containment bin further comprises a first and a second free spinning support roller adjacent to said rear wall of said containment bin.

21. The apparatus of claim 17 wherein said loading door has a first and a second free spinning roller support located thereon.

22. The apparatus of claim 17 further comprising an proximity sensor operably connected to said first motor drive and said second motor drive for disengaging said first motor drive and said second motor drive when fabric is not detected in said apparatus.

23. The apparatus of claim 17 further comprising a plurality of light emitting sources located between said first and second side support members.

24. The apparatus of claim 17 wherein said first pinch roller is coated with a rubberized material.

* * * * *